US006374710B2

(12) United States Patent
Kuo

(10) Patent No.: US 6,374,710 B2
(45) Date of Patent: Apr. 23, 2002

(54) UNIVERSAL CAVITY PIT WRENCH

(76) Inventor: Teng-Tang Kuo, No. 2, Lane 55, Li-Ching 1st Street, Chi-Tu District, Keelung City (TW)

( * ) Notice: Subject to any disclaimer, the term of this patent is extended or adjusted under 35 U.S.C. 154(b) by 0 days.

(21) Appl. No.: 09/473,696

(22) Filed: Dec. 29, 1999

(51) Int. Cl.[7] ..... B25B 13/58
(52) U.S. Cl. ..... 81/185; 81/442; 81/448
(58) Field of Search ..... 81/185, 442, 448

(56) References Cited

U.S. PATENT DOCUMENTS 5,386,749 A 2/1995 Kim ..... 81/185
5,460,064 A 10/1995 Zayat, Jr. ..... 81/185
5,644,959 A 7/1997 Howard ..... 81/185
5,791,209 A * 8/1998 Marks
5,806,385 A * 9/1998 Schupp
6,023,999 A * 2/2000 Cho
6,098,507 A * 8/2000 Lin

* cited by examiner

*Primary Examiner*—Joseph J. Hail, III
*Assistant Examiner*—Willie Berry, Jr.
(74) *Attorney, Agent, or Firm*—Bacon & Thomas, PLLC

(57) ABSTRACT

A universal cavity pit wrench having a sleeve with an open end, a mounting panel secured within the sleeve, a plurality of pillar posts that are longitudinally compressible against the mounting panel, and the pillar posts extending out of the open end of the sleeve. The pillar posts are densely packed next to each other and can fill the void of a nut, upon which the sleeve can be rotated to either loosen or tighten the nut.

4 Claims, 5 Drawing Sheets

UNIVERSAL CAVITY PIT WRENCH

BACKGROUND OF THE INVENTION

1. Field of the Invention

Structural design for a universal cavity pit wrench, more specifically that of a wrench or spanner capable of loosening or tightening up screw nuts or operations involving such loosening or tightening effects without directional restrictions executed against nut bearing cavities of any configurations mounted with a plurality of freely retractable pillar posts.

2. Description of the Prior Art

Conventional art for cavity pit wrenches is typically represented by those devices which are adapted specifically to work on hexagonal cavity pit nuts. The dimension of each hexagonal cavity pit nut that corresponds to a hexagonal pillar spanner of a corresponding dimension is chosen to match, to loosen or tighten up an object nut, and this necessitates the user to bring with him a lot of pillar wrenches of different sizes to meet the demand for working with cavity pit nuts of differing sizes. A common practice among the manufacturers is to assemble the pillar spanners in a set for portable handling, but such execution is still not convenient. Further, the size insufficiency can still be a problem all the same, and improvement is still being sought after; while on the other hand, where the nut set in the cavity pit bears a profile other than hexagonal, petal or polygonal, for example, then the conventional hexagonal pillar spanner can do nothing at all, and the user will have to get a specifically configured cavity pit spanner to go ahead with loosening or tightening up operations for the non-hexagonal, petal or polygonal nuts. In the prior art, where a different, unforeseen pattern of cavity pit nut or one bearing a different size is encountered, a correspondingly shaped cavity pit spanner will have to be prepared in order to get the job done, and that necessarily brings about increased need for more supply of more varieties of spanner tools, giving occasion to more chances of confusion and the shortage of such tools is still inevitable from case to case.

In U.S. Pat. Nos. 5,644,959, 5,386,749, and 5,460 064, and similar patents provide, altogether, various multi-purpose wrench designs, but they apply uniquely and only to protrusive type nuts, none of them caters to cavity pit type nuts at all.

SUMMARY OF THE INVENTION

The primary object of the invention, therefore, is to provide a structural design of a universal cavity pit type wrench or spanner, comprising essentially: a sleeving, a mounting panel, a plurality of pillar posts, retainer rods and a number of correspondingly functioning retraction springs, with the plurality of pillar posts being aligned and mounted on top of the sleeving, they, so arranged and endowed with retractable effects, stemmed against the nut bearing cavity pits, are able to drive the nuts as set in the cavity pits to loosen off or contrarily to tighten up, and that means then that one single stereotyped universal spanner will suffice to work on a cavity set nut of one out of quite a number of cavity configuration or sizes, in all conveniences relieving the user of the nuisance of switching to another tool while working on different specifications of cavity set nuts.

A further object of the invention lies in the provision of the structural design for a universal cavity pit spanner wherein the plurality of pillar posts are preferably processed to be polygonal or to yield a thinner diameter, so that once inserted by retraction into the nut bearing pit, a firm, tight-set plunging effect is assured, whereby yet simpler and more reliable application of force with respect to the nut at work is readily achievable.

DETAILED DESCRIPTION OF THE PREFERRED EMBODIMENTS

Figure 1:
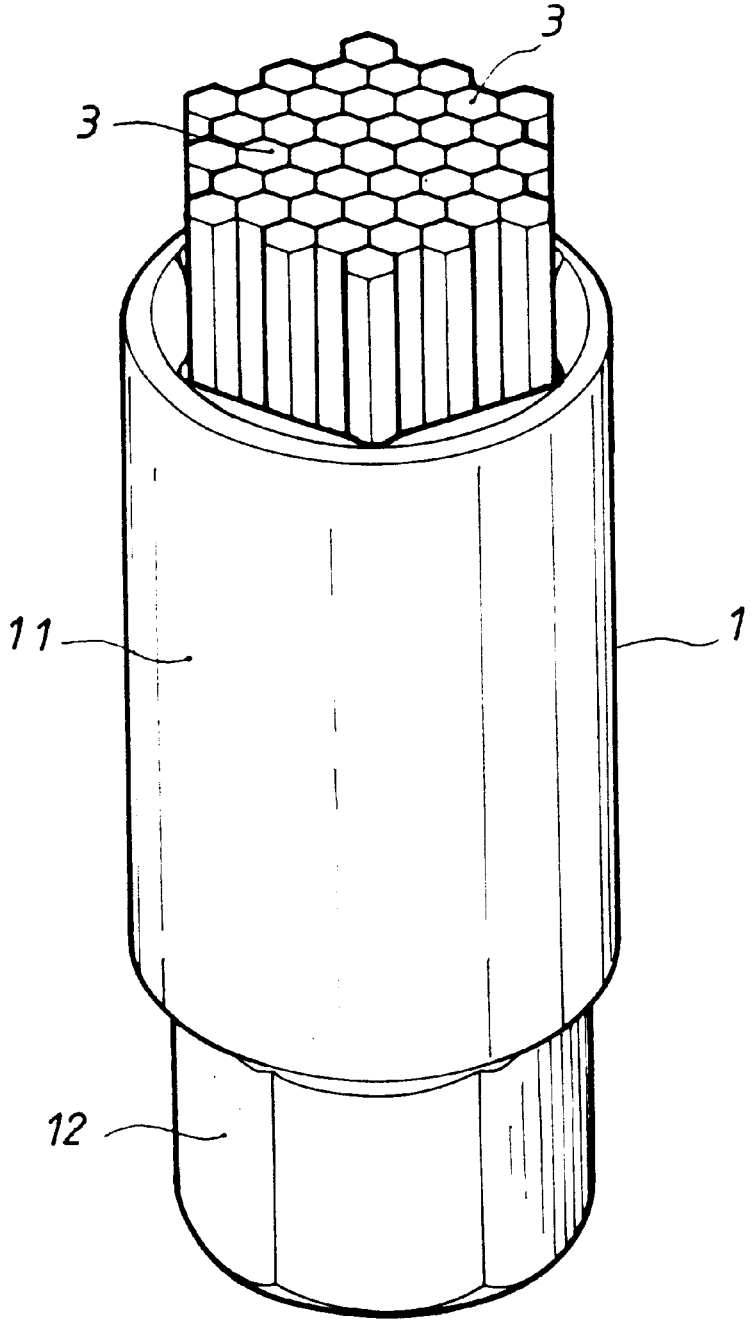
FIG. 1 is a three-dimensional view of the present invention.
Figure 2:
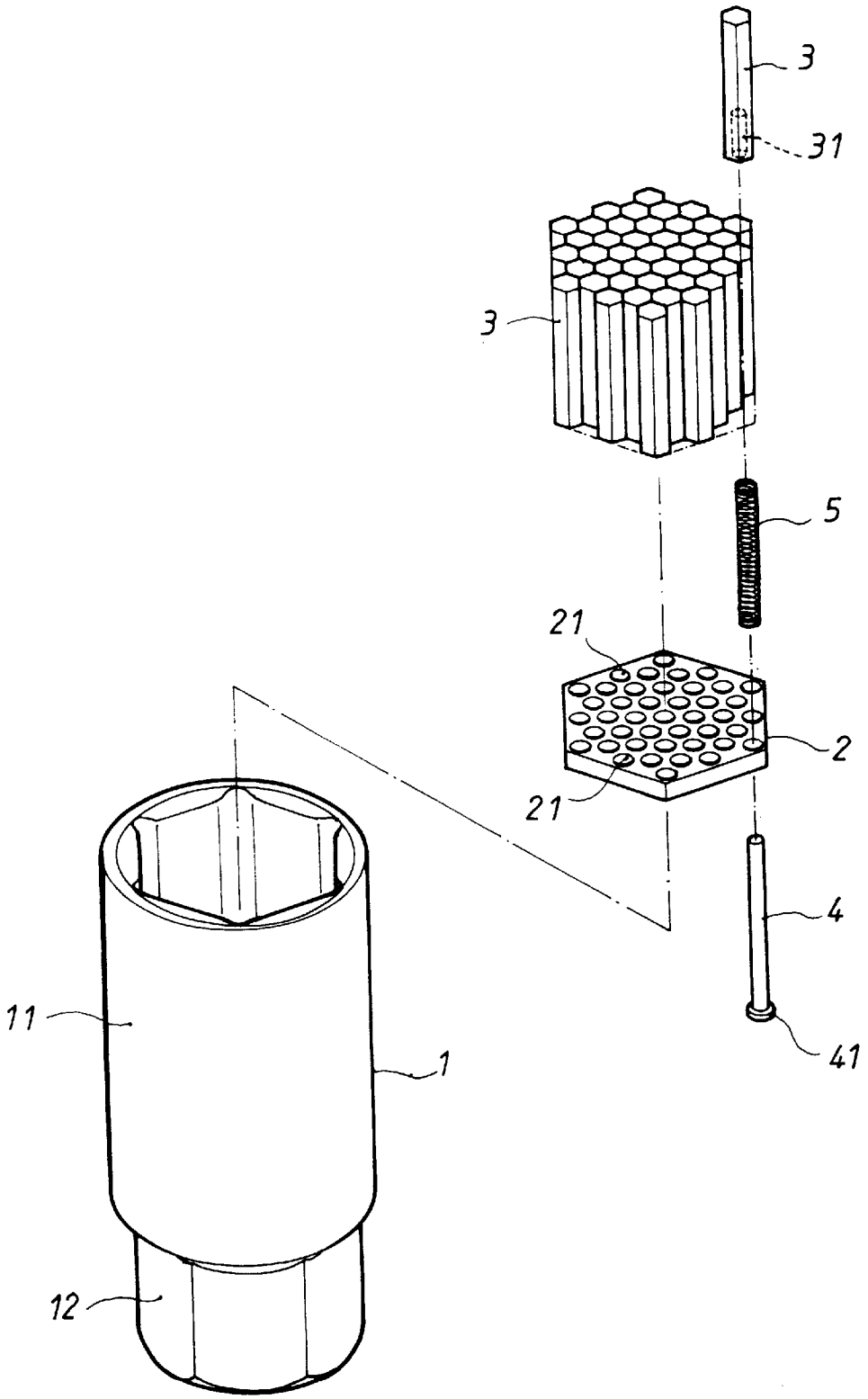
FIG. 2 is an exploded perspective of the invention in a three-dimensional setting.

As shown in FIG. 1 and FIG. 2, the inventive structure of a universal cavity pit wrench comprises essentially: a sleeve 1, a mounting panel 2, a plurality of pillar posts 3, retainer rod 4 and a number of correspondingly functioning retraction spring 5.

Figure 3:
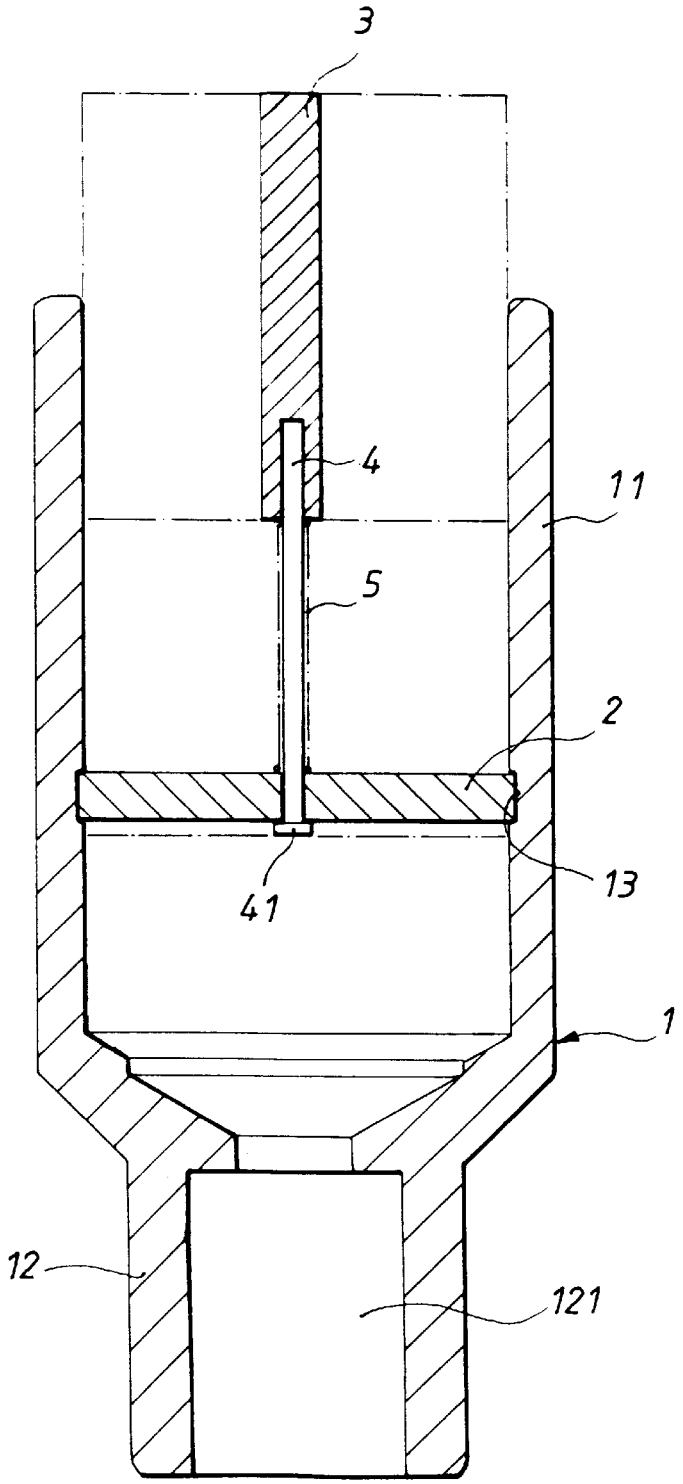
FIG. 3 is a cross-sectional view of the invention.

The sleeve 1, is a hollow-set body and includes an angular shoe 11, hexagonal in shape, for example, for coupling with a grip (not shown in the illustration) on its end edge, the angular shoe 12 further incorporating a square groove 121 (shown in FIG. 4) to accommodate engagement with the grip. The sleeve 1 is generally of a conventional structure but differing in that an annular groove 13, such as what is shown in FIG. 3, is present on the inner wall of the hollow-set body 11 to accommodate the assembly of the mounting panel 2.

The mounting panel 2 is a sheet shape profiled to be secured in the annular groove 13 on the inner wall of the sleeve 1, and once so matched, the engagement is made, on the surface of the mounting panel 2 are evenly and densely distributed a plurality of penetration holes 21.

The pillar posts 3 act as strap plunger stems, each having an access hole provided in the tail edge 31.

The retainer rods 4 are thin rods of suitable length, each incorporating a protrusion 41 on one end, the rods piercing respective penetration holes 21 of the mounting panel 2 from below as shown in FIG. 2. The holes 21 are sized to receive respective retainer rods 4 for coupling with retraction spring 5 placed on the protruded rods 4 such that one end of each spring 5 rests on the mounting panel 2 as shown in FIG. 3.

The retraction springs 5 are mounted on and around respective retainer rods 4 in order to bring retainer rods 4 inserted altogether into the insertion holes 31 on the end edges of corresponding pillar posts 3 so as to form a compact coupling. Such coupling may instead be executed in the form of common differential compacting union by setting the bore of the insertion holes 31 to be slightly smaller than the diameter of the insertion ends of the retainer rods 4, or else connected by glue, or via helically applied locking seals.

Figure 4:
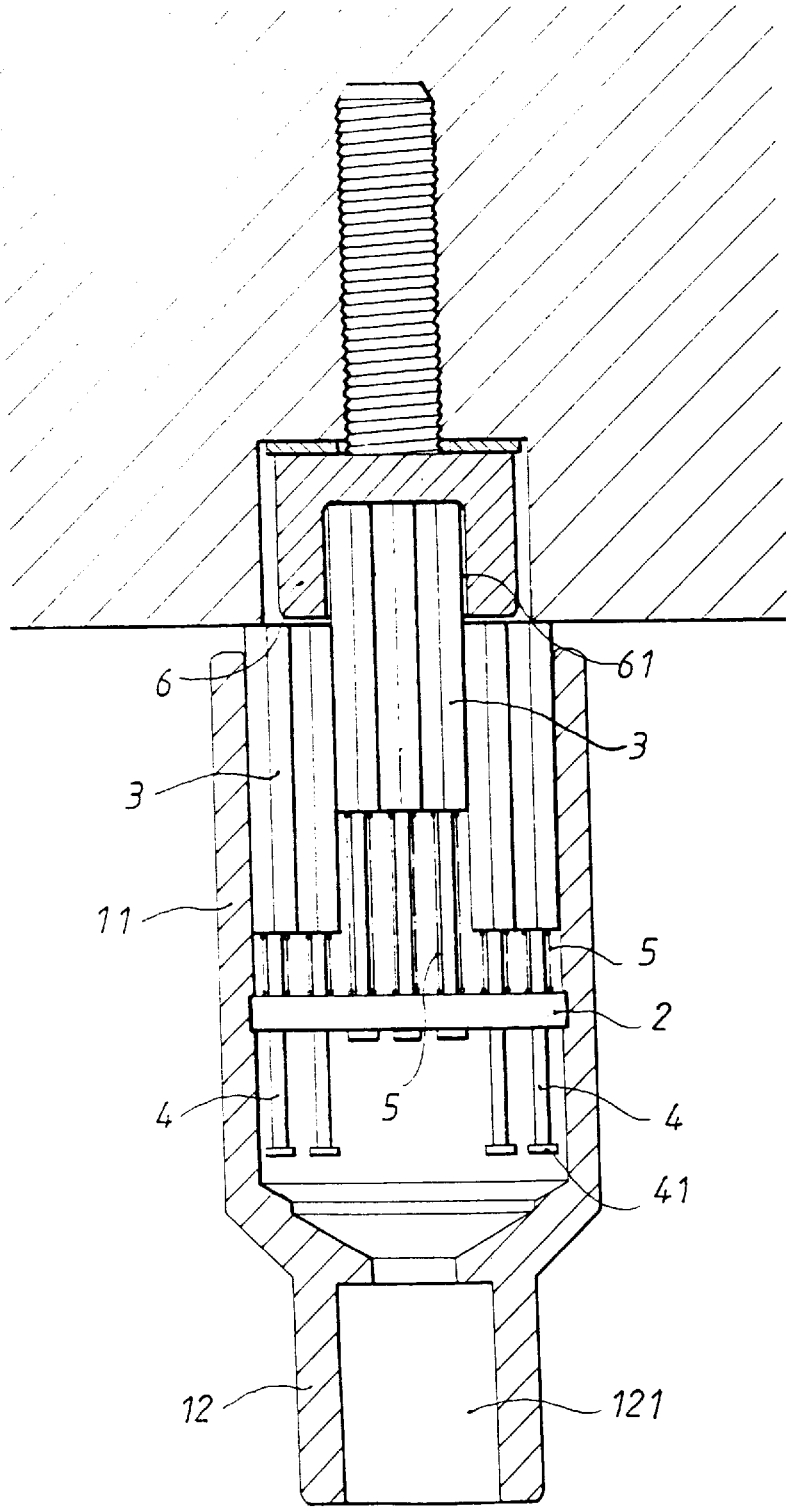
FIG. 4 is a cross-sectional view of the invention in the process of execution of loosening or tightening up of an object nut set in a working cavity pit according to the invention.

For assembly, the pillar posts 3, retainer rods 4 and retraction springs 5 are first mounted one by one, symmetrically onto the mounting panel 2. Next, the mounting panel 2 is secured onto the inner annular groove 13 of the sleeve 1 being thrusted by the retraction spring 5, the respective pillar posts 3 are normally neatly projected over the top edge of the sleeve 1, so that they may project into the cavity pit 61 of an external nut 6 as shown in FIG. 4. Regardless of the specific pattern or configuration of the cavity pit of the nut, when some or all of the pillar posts 3 are inserted into the cavity pit 61, this permits the loosening or tightening up of the nut 6 when the sleeve 1 is rotated along its longitudinal axis.

Figure 5:
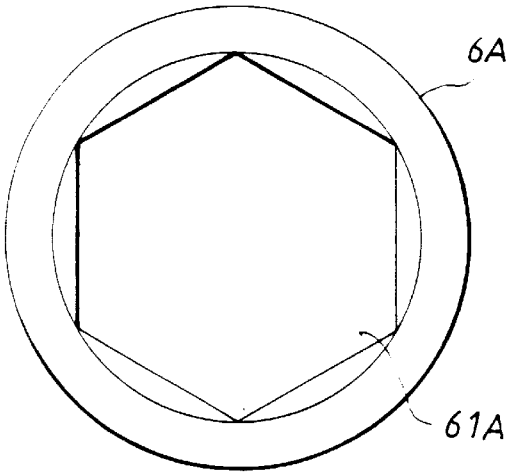
FIG. 5 is a top view of a conventional hexagonal cavity set nut.
Figure 6:
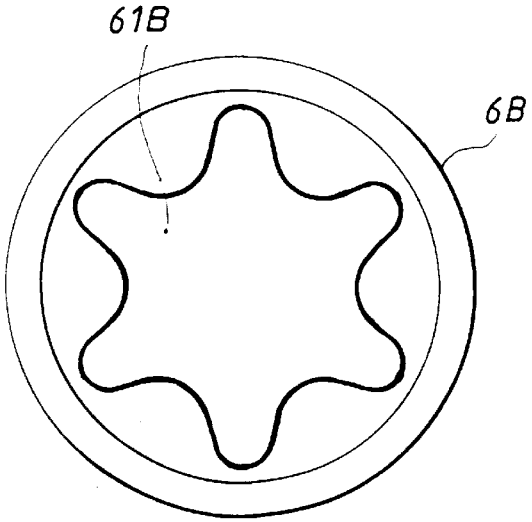
FIG. 6 is a top view of a conventional petal pattern cavity set nut.
Figure 7:
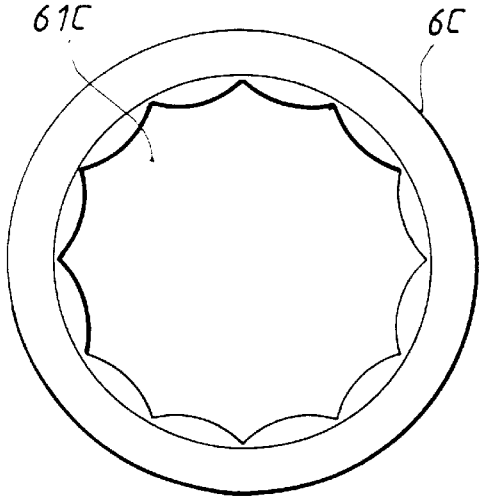
FIG. 7 is a top view of a conventional polygonal cavity set nut.

The design of the invention by way of the plurality of pillar posts 3 movably mounted upon the nut bearing cavity pits 61A, 61B or 61C as provided therewith, nuts of various conceivable patterns or design, i.e., hexagonal 6A, petal 6B, or polygonal 6C, etc. as illustrated in FIG. 5 through FIG. 7, may readily be driven to a loosened state or to the contrary, to a tightened-up state as desired. Thus, with a single, simply stereotyped universal cavity pit wrench according to the invention, it is possible for the inventive wrench to work, for all purposes for which a wrench or spanner is meant to serve, with and on the bearing cavity pit of any nut of conceivable or existing pattern or design.

Moreover, as a characteristic feature of the invention, the plurality of pillar posts 3 to be employed are preferably polygonal or of such dimension that their diameters are rendered thinner, since this will assure a better fit in the cavity pit of a nut 6 on the one hand, and of more consistent, compact alignment when set in the nut bearing cavity pit of a nut 6, on the other hand, facilitating easier application force during operation.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. A universal cavity pit wrench adapted for a pitted nut, the universal cavity pit wrench comprising:

a sleeve;

a mounting panel;

a plurality of pillar posts;

a plurality of retainer rods and corresponding retraction springs;

the sleeve comprising a hollow-set body with an inner wall and an open end, the sleeve configured to accommodate a coupling with a grip, the sleeve having an annular groove built on the inner wall of the hollow-set body;

the mounting panel having a lower side, the mounting panel comprising a sheet profiled to match the annular groove on the inner wall of the hollow-set body of the sleeve, the mounting panel secured on the annular groove, the mounting panel including evenly and densely distributed plurality of penetration holes;

the plurality of pillar posts extending out of the open end of the body of the sleeve, each of the pillars comprising strap plunger stems having an access hole provided on a tail edge thereof;

the plurality of retainer rods each comprising a thin rod having a protrusion on an end thereof, the retainer rods piercing through the mounting panel from the lower side of the mounting panel;

a plurality of retraction springs placed on a respective one of the retainer rods and compressible between the mounting panel and the pillar posts always remain extended out of the open end of the body;

the retainer rods are inserted into the respective insertion holes on the tail edge of corresponding pillar posts to form compact couplings therebetween;

the pillar posts are thrust by the retraction spring out of the open end of the body of the sleeve while retained by the retainer rods at the mounting panel, such that the pillar posts may project fully into a nut bearing cavity pit of a pitted nut, without regard to the pattern of the pitted nut in order to facilitate loosening or tightening up of a pitted nut having a nut bearing cavity pit, upon the rotation of the wrench.

2. The universal cavity pit wrench adapted for a pitted nut, the universal cavity pit wrench according to claim 1, wherein the coupling between the retainer rod and pillar posts is selected from a group consisting of a common differential compaction bonding, glue application and helically applied locking means.

3. The universal cavity pit wrench adapted for a pitted nut, the universal cavity pit wrench according to claim 1, wherein the pillar posts are shaped in a polygonal configuration.

4. The universal cavity pit wrench adapted for a pitted nut, the universal cavity pit wrench according to claim 1, herein the pillar posts are densely packed together.

* * * * *